US006321055B1

(12) United States Patent
Mashtare et al.

(10) Patent No.: US 6,321,055 B1
(45) Date of Patent: Nov. 20, 2001

(54) APPARATUS FOR NON-INTERACTIVE ELECTROPHOTOGRAPHIC DEVELOPMENT

(75) Inventors: Dale R. Mashtare, Bloomfield; Christopher Snelling, East Rochester, both of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/438,599

(22) Filed: Nov. 12, 1999

(51) Int. Cl.[7] ..... G03G 15/08
(52) U.S. Cl. ..... 399/266
(58) Field of Search ..... 399/266, 290, 399/291

(56) References Cited

U.S. PATENT DOCUMENTS 4,557,992 12/1985 Haneda et al. ..... 430/122
4,868,600 9/1989 Hays et al. .
5,010,368 * 4/1991 O'Brien ..... 399/266
5,409,791 4/1995 Kaukeinen et al. ..... 430/54
5,758,239 * 5/1998 Matalevich ..... 399/266
5,809,385 * 9/1998 Snelling et al. ..... 399/266

* cited by examiner

*Primary Examiner*—William J. Royer
(74) *Attorney, Agent, or Firm*—Lloyd F. Bean, II

(57) ABSTRACT

Apparatus for non-interactive, dry powder development of electrostatic images on an imageable surface with developer material; including a housing containing developer material; a resonating donor member, spaced from the imageable surface, for transporting developer material to a development zone adjacent the imageable surface, the resonating donor member forming a cloud of developer material in the development zone to develop the images.

8 Claims, 5 Drawing Sheets

APPARATUS FOR NON-INTERACTIVE ELECTROPHOTOGRAPHIC DEVELOPMENT

Cross-reference is made to concurrently filed patent applications, Ser. No. 09/438,208 entitled;APPARATUS AND METHOD FOR NON-INTERACTIVE ELECTROPHOTOGRAPHIC DEVELOPMENT, by Kristine A. German, et al., Ser. No. 09/438,212 entitled; APPARATUS AND METHOD FOR NON-INTERACTIVE ELECTROPHOTOGRAPHIC DEVELOPMENT, by Dale R. Mashtare, et al., and Ser. No. 09/438,599 entitled, APPARATUS AND METHOD FOR NON-INTERACTIVE ELECTROPHOTOGRAPHIC DEVELOPMENT, by Dale R. Mashtare, et al.

The invention relates generally to an electrophotographic printing machine and, more particularly, to the non-interactive development of electrostatic images.

BACKGROUND OF THE INVENTION

Generally, an electrophotographic printing machine includes a photoconductive member which is charged to a substantially uniform potential to sensitize the surface thereof. The charged portion of the photoconductive member is exposed to an optical light pattern representing the document being produced. This records an electrostatic image on the photoconductive member corresponding to the informational areas contained within the document. After the electrostatic image is formed on the photoconductive member, the image is developed by bringing a developer material into effective contact therewith. Typically, the developer material comprises toner particles bearing electrostatic charges chosen to cause them to move toward and adhere to the desired portions of the electrostatic image. The resulting physical image is subsequently transferred to a copy sheet. Finally, the copy sheet is heated or otherwise processed to permanently affix the powder image thereto in the desired image-wise configuration.

Development may be interactive or non-interactive depending on whether toner already on the image may or may not be disturbed or removed by subsequent development procedures. Sometimes the terms scavenging and non-scavenging are used interchangeably with the terms interactive and non-interactive. Non-interactive development is most useful in color systems when a given color toner must be deposited on an electrostatic image without disturbing previously applied toner deposits of a different color, or cross-contaminating the color toner supplies. This invention relates to such image-on-image, non-interactive development.

U.S. Pat. No. 4,868,600 to Hays et al. discloses a non-interactive development system wherein toner is first developed from a two-component developer onto a metal-cored donor roll and thereafter disturbed into a powder cloud in the narrow gap between the donor roll and an electrostatic latent image existing on a photoreceptor surface. Development fields created between the donor roll core and the electrostatic latent image harvest some of the toner from the cloud onto the electrostatic image, thus developing it without physically disturbing any previously deposited toner layers. In this method the powder cloud generation is accomplished by thin, AC biased wires strung across the process direction and within the development gap. The wires ride on the toner layer and are biased relative to the donor roll core.

U.S. Pat. No. 4,557,992 to Haneda et al. describes a non-interactive magnetic brush development method wherein a two component developer consisting of magnetically soft carrier materials is carried into close proximity to an electrostatic image and caused to generate a powder cloud by the developer motion due, in part, by the inclusion of an AC voltage applied across the gap between the developer sleeve and the ground plane of the electrostatic image. Cloud generation directly from the surfaces of a two component developer avoids many of the problems created by wires. However, in practice such methods have been speed limited by their low toner cloud generation rate.

U.S. Pat. No. 5,409,791 to Kaukeinen et al. describes a non-interactive magnetic brush development method employing permanently magnetized carrier beads operating with a rotating multipole magnet within a conductive and nonmagnetic sleeve. Magnetic field lines form arches in the space above the sleeve surface creating chains of carrier beads which follow these magnetic field lines. The carrier chains are held in contact with the sleeve and spacing between the developer sleeve and a photoreceptor surface is sufficiently large to maintain the carrier bead chains out of direct contact with the photoreceptor surface. As the core rotates in one direction relative to the sleeve, the magnetic field lines beyond the sleeve surface rotate in the opposite sense, moving chains in a tumbling action, which transports developer material along the sleeve surface. The strong mechanical agitation very effectively dislodges toner particles generating a rich powder cloud, which can be developed to the adjacent photoreceptor surface under the influence of development fields between the sleeve and the electrostatic image. U.S. Pat. No. 5,409,791 is hereby incorporated by reference.

A problem with non-interactive development methods is achieving good solid region development while maintaining good fine line development and vice versa. Many non-interactive development methods function by generating a powder cloud in the gap between a photoreceptor and another member which serves as a development electrode. It is generally observed that this gap should be as small as possible, on the order of 0.010 inches or less. Generally, the larger the gap, the larger become certain image defects in the development of fine lines and edges. As examples of these defects: lines do not develop to the correct width, lines near solid areas are distorted, and the edges of solids are softened, especially at corners. It is understood that these defects are the result of lateral components of the electric field lines occurring due to the charge patterns existing on the image-wise discharged photoreceptor. Electrostatic field lines emanating from the photoreceptor reach up from the latent electrostatic image patterns of lines and at the edges of solid areas and arch back toward the adjacent photoreceptor regions. These lateral components of the electric field lines result in displacement from the intended pathway of the charged toner particles and in incomplete development of the latent electrostatic images. Defects due to the electrostatic field arches are less serious in interactive two component development subsystems because toner particles can be delivered through these field arches by carrier particles. Nor are they an issue in interactive single component development because a strong, cross-gap AC field is superposed which impart sufficient toner particle velocity toward the photoreceptor to overcome the aforementioned field arch patterns.

SUMMARY OF THE INVENTION

The present invention obviates the problems noted with achieving good solid region development while maintaining good fine line development, by providing an apparatus for non-interactive, development of electrostatic images. For, Charge Area Development (CAD) image voltages are set just above the residual voltage development of electrostatic images on an imageable surface with developer material; including a housing containing developer material; a resonating donor member, spaced from the imageable surface, for transporting developer material to a development zone adjacent the image receiving member, the resonating donor member forming a cloud of developer material in the development zone to develop the images.

DETAILED DESCRIPTION OF THE INVENTION

Figure 1:
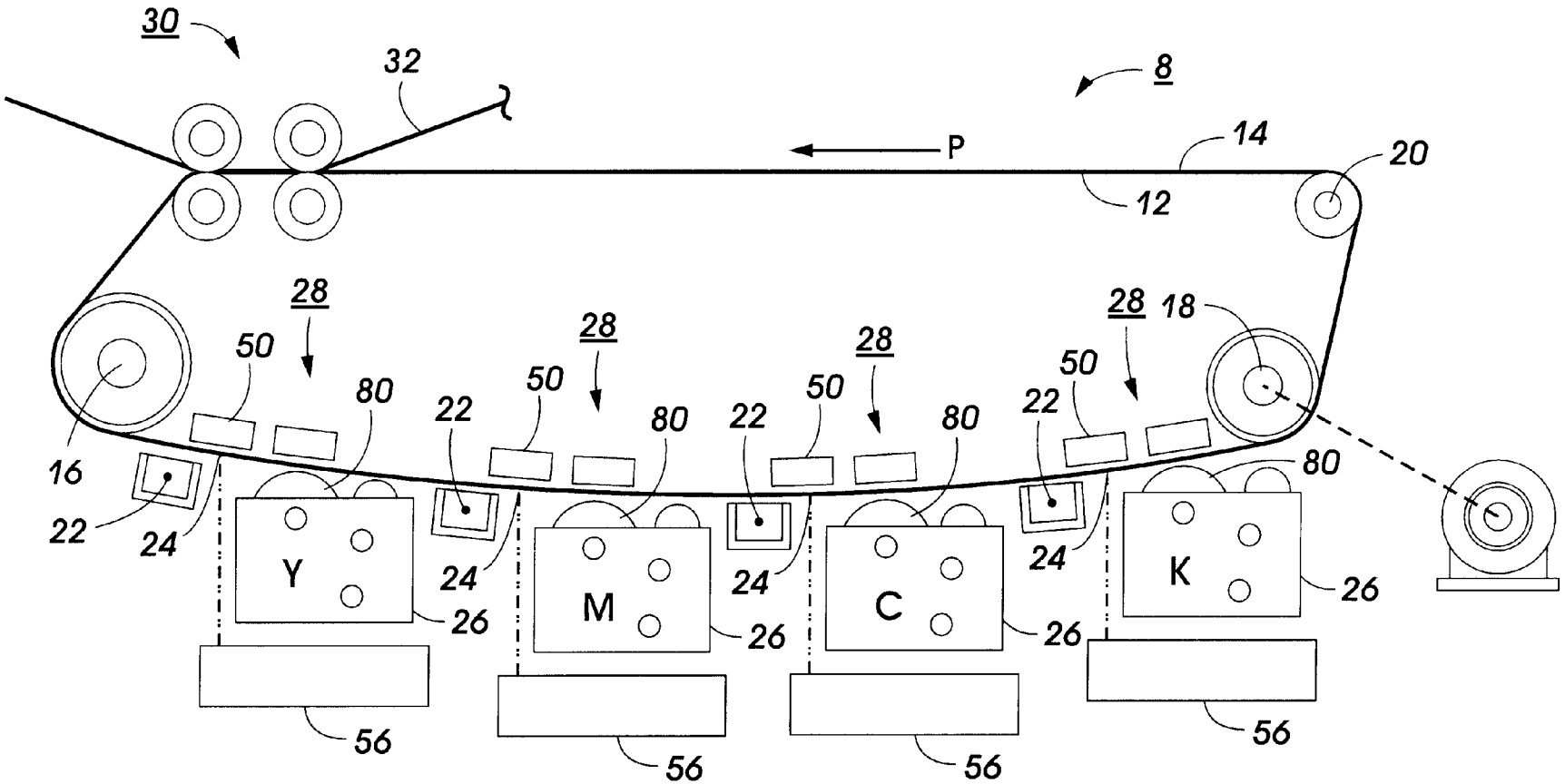
FIG. 1 is a side view, in section, of a four color xerographic reproduction machine incorporating the non-interactive developer of the present invention.

Referring to FIG. 1 of the drawings, there is shown a xerographic type reproduction machine 8 incorporating an embodiment of the non-interactive development system of the present invention, designated generally by the numeral 80. Machine 8 has a suitable frame (not shown) on which the machine xerographic components are operatively supported. As will be familiar to those skilled in the art, the machines xerographic components include a recording member, shown here in the form of a translatable photoreceptor 12. In the exemplary arrangement shown, photoreceptor 12 comprises a belt having a photoconductive surface 14. The belt is driven by means of a motorized linkage along a path defined by rollers 16, 18 and 20, and those of transfer assembly 30, the direction of movement being counterclockwise as viewed in FIG. 1 and indicated by the arrow marked P. Operatively disposed about the periphery of photoreceptor 12 are charge corotrons 22 for placing a uniform charge on the photoconductive surface 14 of photoreceptor 12; exposure stations 24 where the uniformly charged photoconductive surface 14 constrained by positioning shoes 50 is exposed in patterns representing the various color separations of the document being generated; development stations 28 where the electrostatic image created on photoconductive surface 14 is developed by toners of the appropriate color; and transfer and detack corotrons (not shown) for assisting transfer of the developed image to a suitable copy substrate material such as a copy sheet 32 brought forward in timed relation with the developed image on photoconductive surface 14 at transfer assembly 30. In preparation for the next imaging cycle, unwanted residual toner is removed from the belt surface at a cleaning station (not shown).

Following transfer, the sheet 32 is carried forward to a fusing station (not shown) where the toner image is fixed by pressure or thermal fusing methods familiar to those practicing the electrophotographic art. After fusing, the copy sheet 32 is discharged to an output tray.

At each exposure station 24, photoreceptor 12 is guided over a positioning shoe 50 so that the photoconductive surface 14 is constrained to coincide with the plane of optimum exposure. A laser diode raster output scanner (ROS) 56 generates a closely spaced raster of scan lines on photoconductive surface 14 as photoreceptor 12 advances at a constant velocity over shoe 50. A ROS includes a laser source controlled by a data source, a rotating polygon mirror, and optical elements associated therewith. At each exposure station 24, a ROS 56 exposes the charged photoconductive surface 14 point by point to generate the electrostatic image associated with the color separation to be generated. It will be understood by those familiar with the art that alternative exposure systems for generating the electrostatic images, such as print bars based on liquid crystal light valves and light emitting diodes (LEDs), and other equivalent optical arrangements could be used in place of the ROS systems such that the charged surface may be imagewise discharged to form an electrostatic image of the appropriate color separation at each exposure station.

A suitable controller is provided for operating the various components of machine 8 in predetermined relation with one another to produce full color images.

Figure 2:
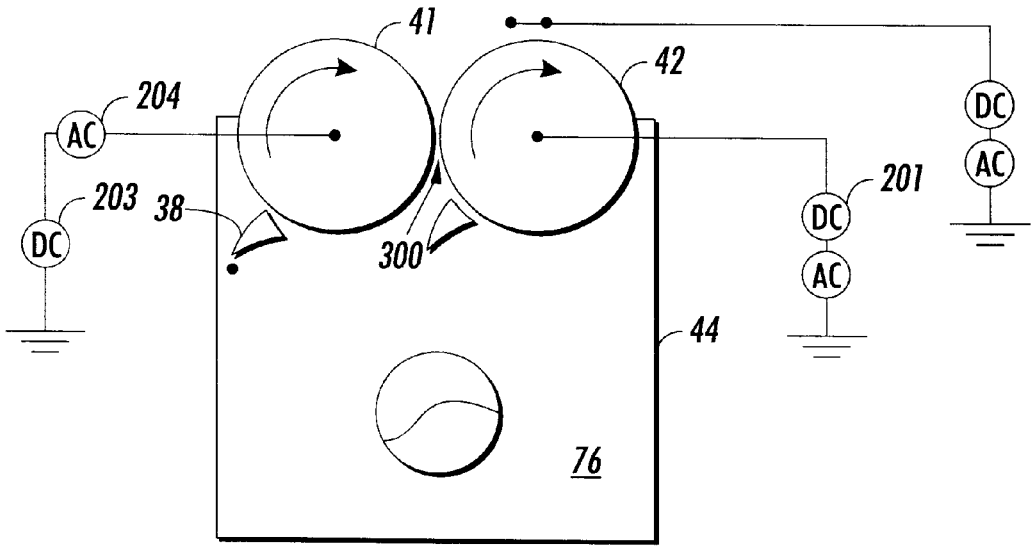
FIG. 2 is an enlarged side view of the developer unit of the present invention.
Figure 3:
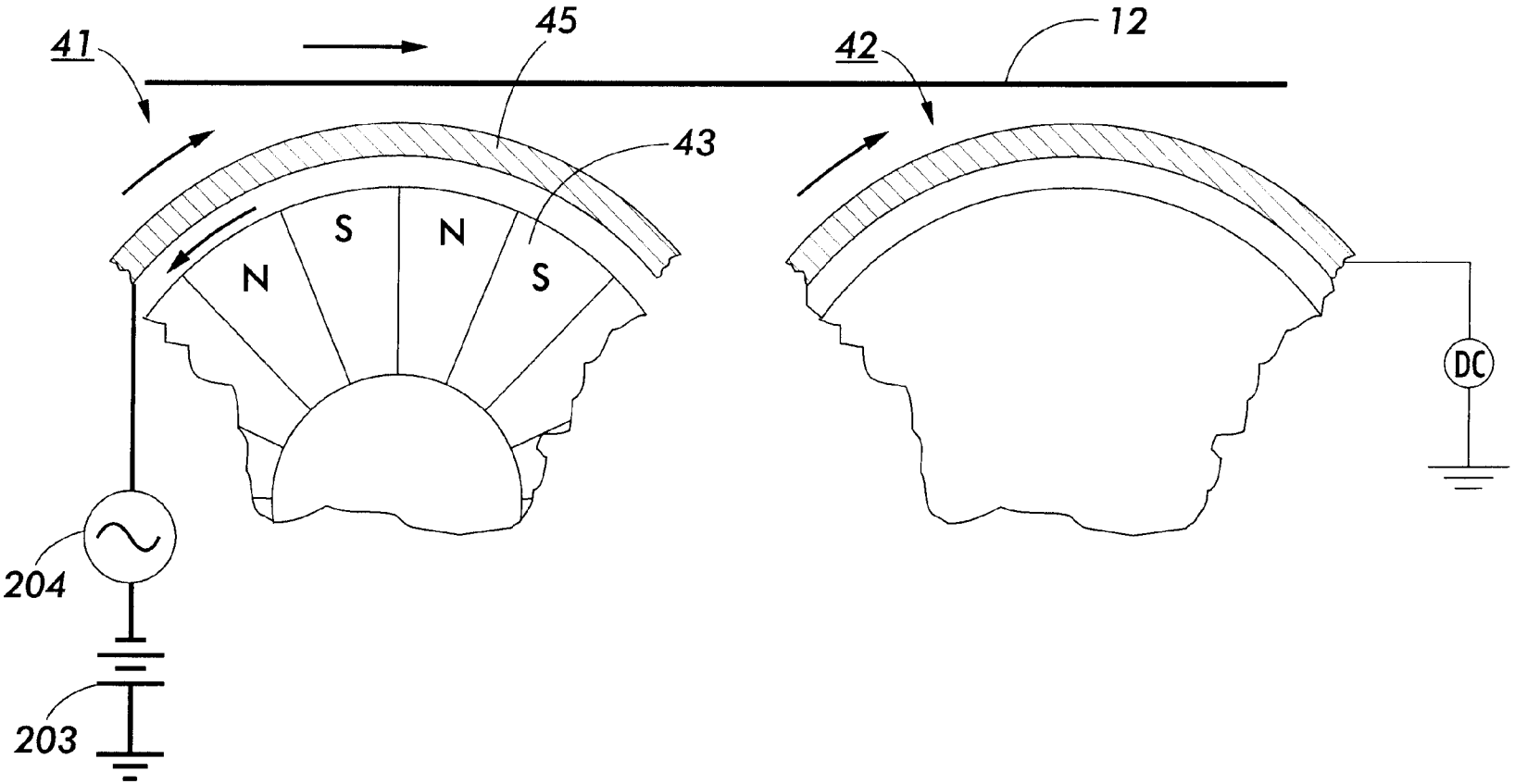
FIG. 3 is an enlarged view of the developer roll shown in FIG.2.

Referring now to FIGS. 2 and 3 in greater detail, developing station 26 includes a developer housing 44 defining a chamber 76 for storing a supply of developer material therein. A toner dispensing cartridge (not shown) dispenses toner particles downward into a sump area occupied by the auger. The auger loads toner onto developing member 41.

Continuing with the description of operation at each developing station 26, developing members 41 and 42 are disposed in predetermined operative relation to the photoconductive surface 14 of photoreceptor 12, the length of developing members being equal to or slightly greater than the width of photoconductive surface 14, with the functional axis of the developing members parallel to the photoconductive surface and oriented at a right angle with respect to the path of the photoreceptor 12. Advancement of each developing member carries the developer blanket into the development zone in proximal relation with the photoconductive surface 14 of photoreceptor 12 to develop the electrostatic image thereon.

Donor member 41 comprises an interior rotatable harmonic multipole magnetic assembly 43 and an outer sleeve 45. The sleeve can be rotated in either the "with" or "against" direction relative to the direction of motion of the photoreceptor belt 12. Similarly, the magnetic assembly can be rotated in either the "with" or "against" direction relative to the direction of motion of the sleeve 45. Blade 38 is placed in near contact with the rotating donor member 41 to trim the height of the developer bed. A cleaning blade (not shown) is placed in contact with the rotating donor member 41 to continuously remove developer from the donor member 41 for return to the developer chamber 76. Donor member 41 has a DC power source 203 and an AC power source 204 electrically attached thereto.

In operation, donor member 41 primary function is to developed solid areas of the latent image. Donor member 41 is spaced between 0.020" and 0.050" from the photoreceptor. A DC voltage by supply 203 is applied to insure background regions of the latent electrostatic image are not developed. For example, in Discharge Area Development (DAD) images, the DC voltage is set to 100 to 500 volts in accordance to of the photoreceptor about 50 to 200 volts. Interactivity is reduced by using low momentum toner i.e. minimizing the applied AC voltage; and by maintaining a relatively large spacing between donor member 41 and photoreceptor 12. For example, the development system of the present invention can be setup as follows. For donor member 41, it is desired to have a toner bed height between 0.015" to 0.045", this can be accomplished by configuring the pole spacing of the magnetic assembly to give the desired bed height or trim blade 38 could be employed to give the desired bed height. The AC frequency is selected to provide maximum development below interactively which is 1 Khz to 4 Khz.

Donor member 42 primary function is to develop remaining fine lines and edges by reducing fringe field effects by employing a close photoreceptor to donor member spacing and a low toner bed height. Since large solid areas are developed by donor member 41 thereby neutralizing major portions of the charge areas of the latent image. This enables improved developability of the fine lines and edge details to be developed by donor member 42.

Figure 4:
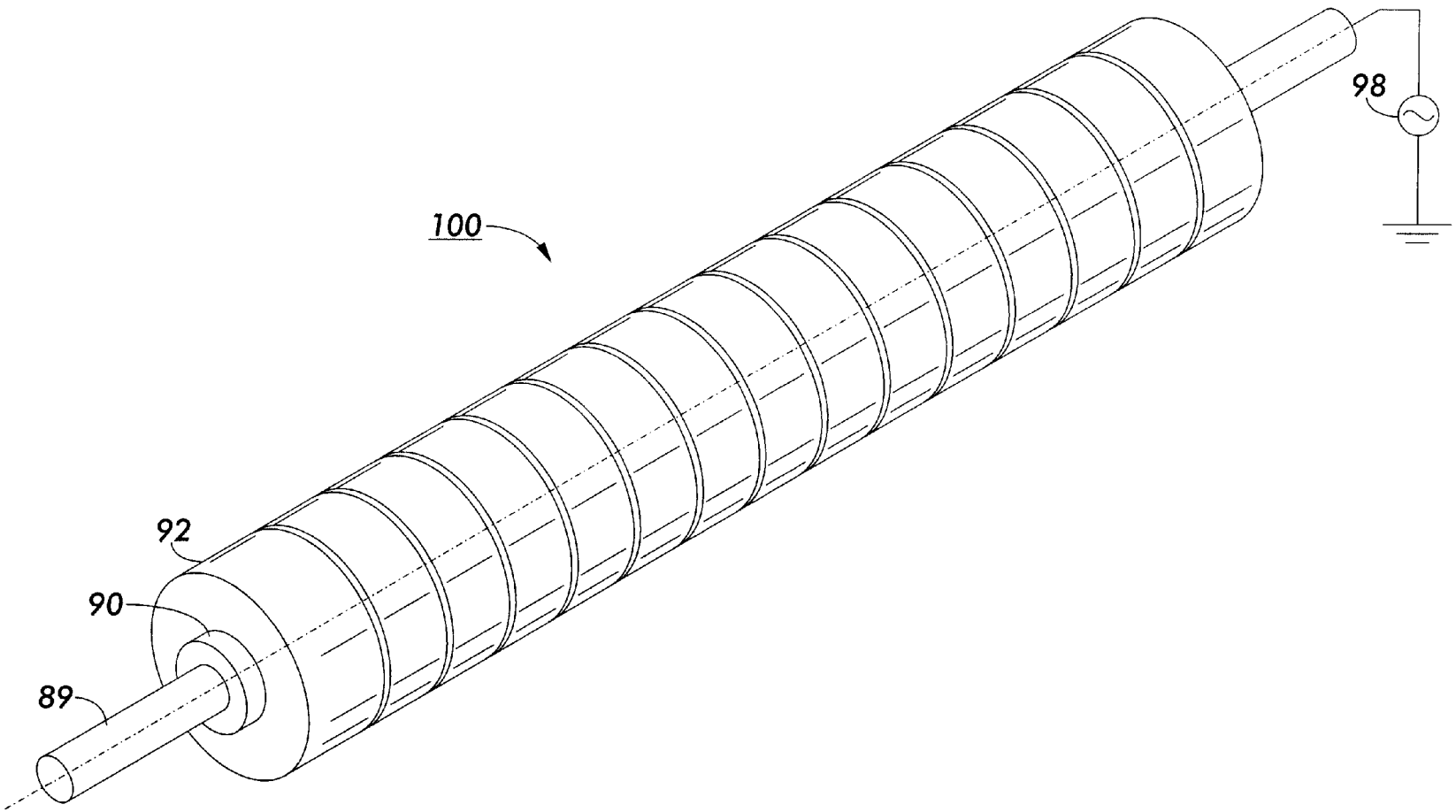
FIG. 4 is a perspective view of a cylindrical rotatable resonating assembly in accordance with the present invention.
Figure 5:
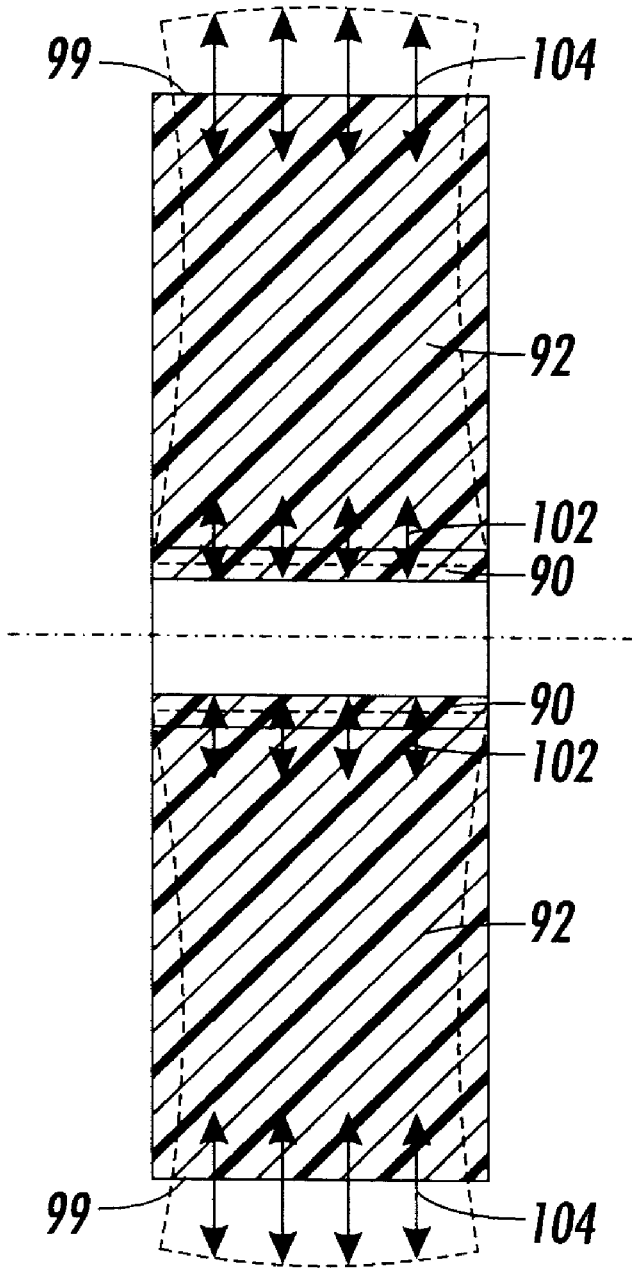
FIG. 5 is a cross sectional view taken along a diameter of one embodiment of a cylindrical resonating assembly in accordance with the present invention, illustrating a radially excited uniform waveguide transducer segment.

Donor member 42 is a cylindrical and rotatable resonating assembly as taught in U.S. Pat. No. 5,697,035 which is hereby incorporated by reference. As shown in FIG. 4, the resonator 100 may include a transducer element 90 having a waveguide member 92 which is press fitted or otherwise bonded to the transducer 90. The transducer 90/waveguide 92 combination making up the resonator 100 is further mounted on a conductive shaft 89 which is further coupled to a power supply such as an A.C. voltage source 98 generally operated at a frequency between 20 kHz and 200 kHz and typically at a frequency of approximately 60 kHz for providing an electrical bias to drive transducer element 90. The shaft 89 provides a fixed support for the cylindrical resonator and an axis of rotation for the cylindrical resonator. The transducer 90 is preferably provided in the form of a piezoelectric material which may be fabricated, for example, from lead zirconate titontate or some form of piezopolymer material. The waveguide member 92, on the other hand, is preferably fabricated from aluminum. Each resonating element includes a waveguide in the form of a so-called uniform waveguide segment having a uniform cross sectional dimension along the width thereof, as shown in the cross-sectional view of FIG. 5. This figure illustrates a radially excited transducer segment wherein the orientation of the dominant electrical expansion property of the piezoelectric transducer segment is in the direction of the desired transducer output as indicated by the vertical arrows 102 and 104. In the case of the radially excited uniform waveguide resonator of FIG. 5, piezoelectric transducer element 90 generates electrical expansion which, in turn, produces piston-like motion at the contact surface 99 of the waveguide member 92.

Donor member 42 is loaded with toner by donor member 41 at reload zone 300. Donor member 42 has a DC bias applied thereto by supply 201. The donor member 41 is held at an electrical potential difference relative to the donor member 42 to produce the field necessary for toner development onto donor member 42. The toner layer on the donor member 42 is vibrated thereby generating a cloud of toner particles in the development zone. This cloud develops the remaining fine lines and edges of the latent image. Donor member can be positioned between 0.005" and 0.015" from the photoreceptor.

An advantageous feature of using a resonating donor member is reduce toner adhesion forces in the development zone which allows the use of low DC fields. Low DC fields which are less than 1 volts/micros compare to 3–4 volts/micros which are employed in some prior art devices which is near air breakdown which causing development noise and toner explosion in the development zone. Another feature of the resonating donor member is it generates a low localized toner cloud.

The invention has been described in detail with particular reference to a preferred embodiment thereof, but it will be understood that variations and modifications can be effected within the spirit and scope of the invention as described hereinabove and as defined in the appended claims.

What is claimed is:

1. Apparatus for non-interactive, dry powder development of electrostatic images on an image receiving member having an imageable surface with developer material including marking particles comprising:

a housing containing developer material; a resonating donor member, spaced from the image receiving member, for transporting marking particles to a development zone adjacent the image receiving member, said resonating donor member forming a cloud of marking particles in the development zone to develop said images.

2. The apparatus of claim 1, further comprising a magnetic roll for loading said resonating donor member with toner.

3. The apparatus of claim 1, further comprising means for biasing an outer surface of said resonating donor member with a DC bias so that toner is attracted thereto.

4. The apparatus of claim 1, wherein said resonating donor member includes a cylindrical and rotatable resonating assembly.

5. The apparatus of claim 4, wherein said resonating assembly includes a transducer element having a waveguide member attached thereto; and an AC power supply for providing an electrical bias to drive said transducer element.

6. The apparatus of claim 5, wherein said AC power supply is adjusted so that said resonating donor member produces a toner cloud height between 0.005" and 0.015".

7. The apparatus of claim 1, wherein said resonating donor member is spaced between 0.005" and 0.015" from said imageable surface.

8. Apparatus for non-interactive, dry powder development of electrostatic images on an image receiving member having an imageable surface with developer material including marking particles comprising:

a housing containing developer material;

a resonating donor member, spaced between 0.005" and 0.015 from the image receiving member, for transporting marking particles to a development zone adjacent the image receiving member, said resonating donor member forming a cloud of marking particles in the development zone to develop said images, said resonating donor member includes a transducer element having a waveguide member attached thereto; and an AC power supply for providing an electrical bias to drive said transducer element, said AC power supply is adjusted so that said resonating donor member produces a toner cloud height between 0.005" and 0.015".

* * * * *